United States Patent [19]

Ohnishi et al.

[11] 4,105,059

[45] Aug. 8, 1978

[54] METHOD OF REDUCING THE CASTING WIDTH DURING CONTINUOUS CASTING

[75] Inventors: Masayuki Ohnishi; Hisashi Ohmori; Yoshiji Yamamoto, all of Kurashiki, Japan

[73] Assignee: Kawasaki Seitetsu K.K., Kobe, Japan

[21] Appl. No.: 834,988

[22] Filed: Sep. 20, 1977

[30] Foreign Application Priority Data

Sep. 27, 1976 [JP] Japan ..... 51-115536

[51] Int. Cl.[2] ..... B22D 11/04

[52] U.S. Cl. ..... 164/4; 164/83; 164/154; 164/418

[58] Field of Search ..... 164/435, 436, 82, 418, 164/154.4, 83, 260

[56] References Cited

U.S. PATENT DOCUMENTS 3,838,730 10/1974 Nagaoka et al. ..... 164/4 X 3,926,244 12/1975 Meier et al. ..... 164/82 X

*Primary Examiner*—Francis S. Husar
*Assistant Examiner*—John S. Brown
*Attorney, Agent, or Firm*—Werner W. Kleeman

[57] ABSTRACT

A method of decreasing the width of a continuously cast strand, especially a steel strand, wherein at least one small or narrow side of an adjustable continuous casting mold is displaced during the casting operation. The small side is intermittently moved in the direction of the center or lengthwise axis of the mold at a mean velocity of $v'' \leqq f \times S \times \tan\theta$, in such a manner that there successively follow one another movement- and standstill time sections each amounting to $\frac{1}{2}f$ minutes wherein $f$ represents the mold oscillation frequency, S the length of stroke or double amplitude of the mold, and $\theta$ the taper angle enclosed by the short side of the mold with the vertical.

2 Claims, 5 Drawing Figures

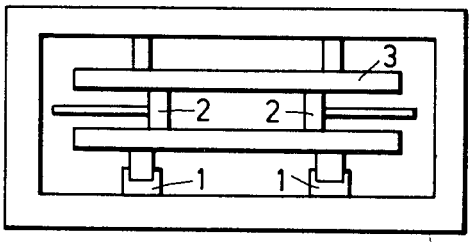
Fig.1
Fig. 2
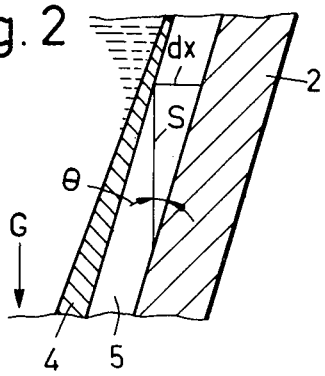
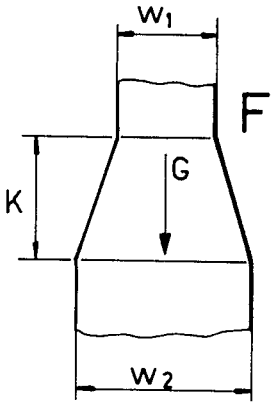
Fig. 4
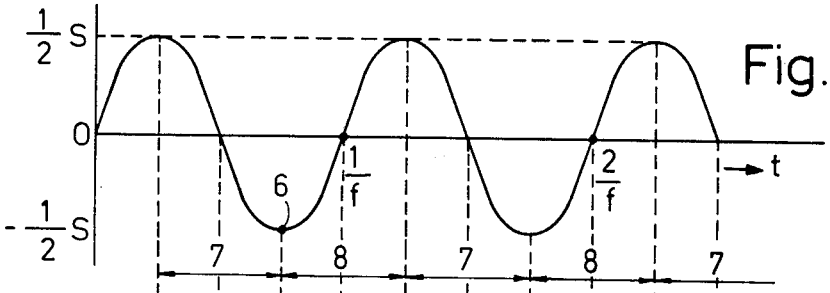
Fig.3a
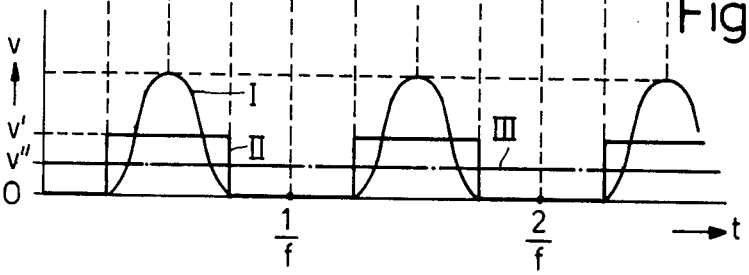
Fig.3b

METHOD OF REDUCING THE CASTING WIDTH DURING CONTINUOUS CASTING

BACKGROUND OF THE INVENTION

The present invention relates to a new and improved method of decreasing the width of a continuously cast strand, especially a steel strand, wherein at least a short or narrow side of an adjustable mold can be moved during the continuous casting operation.

There has already become known to the art an accepted method wherein there is used a continuous casting mold having a short or narrow side which is divided into an upper part and a lower part. During change in the width of the cast strand, the upper non-imbued or non-wetted part is adjusted to a desired extent or position and the withdrawal of the steel strand as well as the oscillation device for the mold is stopped. The bath level in the mold ascends until arriving at the upper part of the mold. After there has been formed an adequate skin or shell thickness at the cast strand or casting, during which time the infeed of the melt to the mold at least must be throttled, the lower mold part, as soon as such is possible is adjusted and the withdrawal of the cast strand can proceed. What is particularly disadvantageous with this technique is that due to stopping the movement of the steel strand there is undesirably altered the cooling conditions, something which is unsatisfactory from the metallurgical standpoint, because then there no longer can be ensured for a constant quality of the cast strand over the entire strand length.

There is also known to the art a method wherein a narrow or short side of the mold is pivoted about its lower edge in tilting relationship to the center of the mold, and thereafter the small side is then pivoted or rocked about its upper edge towards the center of the mold. To carry out these operations it is necessary to exert large forces upon the narrow or small sides of the mold, in opposition to the ferrostatic pressure, and there is an extremely great danger of forming fissures at the soft shell or skin of the cast strand during pivoting or rocking of the lower part of the short side towards the center of the mold. Also, reinforcement plates immersed in the steel melt only partially overcome this danger.

SUMMARY OF THE INVENTION

Hence, with the foregoing in mind it is a primary object of the present invention to provide an improved method of decreasing the width of a continuously cast strand, in particular a steel strand, during the continuous casting operation, in a manner not associated with the aforementioned drawbacks and limitations of the prior art proposals.

Another and more specific object of the present invention aims at providing a method of the previously mentioned type, enabling uninterrupted withdrawal of the strand and maintaining in operation the oscillation device of the mold, and furthermore, wherein it is possible to maintain extremely small the deformation forces exerted upon the soft skin or shell of the cast strand, allowing for an unaltered taper and which method can be performed quickly and in an uncomplicated manner.

Now in order to implement these and still further objects of the invention, which will become more readily apparent as the description proceeds, the method of this development is manifested by the features that the small side of the oscillating mold is intermittently moved towards the center of the mold at a mean or average speed of $v'' \leqq f \times S \times \tan\theta$, in such a manner that there follow in succession movement- and standstill time sections each amounting to $\frac{1}{2}f$ minutes, wherein $f$ represents the frequency of the mold oscillations, S the length of stroke or double amplitude, and $\theta$ the taper angle of the short side of the mold enclosed with the vertical.

The method of the invention works independently of the initially adjusted taper. The oscillation device is advantageously maintained in operation so that it can impart oscillations to the mold. By virtue of the fact that each time the small side is moved towards the center of the mold, when during an oscillation cycle a formed gap between the steel strand and the small side is compensated, the deformation forces which are exerted upon the soft strand shell or skin are extremely small. The strand withdrawal speed is not changed. Apart from the foregoing the inventive method can be carried out rapidly and in an uncomplicated fashion.

Advantageously, during the reduction in the strand width there is maintained a play or intermediate space of at most 0.5 mm between the small sides and the long sides of the continuous casting mold, so that there are extensively eliminated friction forces at the small sides, although steel melt cannot enter into such intermediate space or play between the small side and the related long side of the mold.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic top plan view of an adjustable continuous casting mold which is useful for the practice of the inventive method;

FIG. 2 schematically illustrates the alternating relationship between the mold short side and the continuously cast strand;

FIG. 3*a* is a graph illustrating the change in position of the mold brought about by the mold oscillations;

FIG. 3*b* is a graph illustrating the movement- and standstill time sections; and FIG. 4 illustrates a section of a continuously cast strand having a transition region or zone.

DETAILED DESCRIPTION OF THE PREFERRED EMBODIMENTS

Describing now the drawings, it is to be understood that only enough of the continuous casting installation or machine has been shown in the drawings, to simplify the illustration, while enabling those skilled in the art to readily understand the underlying concepts and principles of the invention. Turning attention to FIG. 1, there is illustrated therein an adjustable continuous casting mold arranged in a not particularly referenced fixed frame. This continuous casting mold embodies two essentially parallel short or narrow sides 2 and two essentially parallel long sides 3. As is conventional in this art, the short sides 2 and long sides 3 enclose therebetween the mold compartment in which there is formed the continuously cast strand. Suitable clamping devices 1, which may be constituted by hydrocylinders or springs, or other suitable equivalent structure, serve to urge the two parallel small sides 2 at right angles against the pair of parallel long sides 3. The small sides 2 of the mold 2, 3 are movable horizontally between the long sides 3 when the clamping devices 1 are relieved in such a manner that there is formed a small intermediate space or play amounting at most to 0.5 mm between the small sides 2 and the long sides 3, and which intermediate space does not allow the passage of the melt therethrough. The short sides 2 can be positionally adjusted by conventional structure, such as threaded spindles or other suitable means. While details of the adjustment means for altering the position of the short sides 2 of the mold 2, 3 are unimportant for understanding the underlying concepts of the invention, typical structure suitable for this purpose has been disclosed in greater detail in our commonly assigned, copending United States application Ser. No. 834987 filed Sept. 20, 1977 and entitled "Method of Enlarging the Strand Width of a Steel Strand During Continuous Casting" (attorneys docket 6120), to which reference may be readily had and the disclosure of which is incorporated herein by reference. Each small side 2 already possesses a taper or conicity $\theta$, which constitutes the angle which the small side 2 encloses with the vertical, and such taper $\theta$ need not be changed during decrease of the strand width during the continuous casting operation. A not particularly illustrated, conventional mold oscillation device imparts to the mold 2, 3 oscillations at a frequency of $f$ (cycle/min) and with a length of stroke or oscillation width (double amplitude) S (mm).

During adjustment of the width of the cast strand, after there has been set or adjusted the intermediate space or play between the long side 3, such as appearing at the bottom of the showing of FIG. 1 and the adjacent short sides 2, in the manner previously discussed, then the short sides 2 of the mold 2, 3 are moved almost horizontal, as a function of the oscillation cycle of the mold, in the direction of the center or lengthwise axis of the continuous casting mold 2, 3. As soon as there has been obtained the desired spacing between the short sides 2 of the mold 2, 3, then all of the mold sides 2, 3 are again fixed in relation to one another by the clamping device or clamping means 1. As a result, there is now completed the operation of reducing the width of the cast strand.

FIG. 2 illustrates a gap 5 between the inclined short side 2 of the mold 2, 3, which has just arrived at its lower dead-center position, and a steel strand 4, which gap 5 will be formed if there is neglected the withdrawal speed G and bending of the strand shell or skin of the steel strand 4 which still possesses a liquid core. The horizontal width of the gap has been designated by $dx$, which, related to an oscillation, can be expressed by the equation $dx = S \cdot \tan\theta$ (Equation 1). Attention is here directed to FIG. 3*a* which portrays graphically the sinusoidal positional change of the short side 2, wherein the length of stroke or double amplitude S has been plotted along the ordinate and the time $t$ along the abscissa. The time duration or period of an oscillation amounts to $1/f$ minutes. Now if each short side 2 is only horizontally displaced in the time when the theoretical width $dx$ increases from null to its maximum value, i.e., during the downward movement of the mold 2, 3, in other words during a movement time section 7, and specifically at a speed derived from the position curve shown in FIG. 3*a*, which is portrayed as a sinusoidal curve I in FIG. 3*b*, the gap 5 cannot form at all, so that, on the one hand, the steel strand 4 bears without interruption at the inside wall or inner surface of the short or narrow side 2 and, on the other hand, no forces act upon the strand shell or skin.

However, due to the bending through of the strand shell and the continuous withdrawal thereof, forces act upon the strand shell, which, however are very small. There also is formed a very small additional force upon the strand shell when the small side is displaced, during the movement time section 7, at a constant mean or average speed according to curve II of FIG. 3*b* (yet the strand 4 still remains in contact). The mean or average speed during a time section 7 can be derived from the following: $dx = v' \cdot \frac{1}{2}f$ (Equation 2), wherein the time duration of one-half of an oscillation, i.e. a movement time section 7, possesses the value of $\frac{1}{2}f$ minutes. Equating the Equations 1 and 2 results in: $v' = 2f \cdot S \cdot \tan\theta$mm/min. (Equation 3). Curves I and II of FIG. 3*b*, where the time $t$ is plotted along the abscissa and the speed or velocity $v$ along the ordinate, illustrate two possible speeds of the small side 2. The curves I and II portray an intermittent speed course, wherein a movement time section 7 is followed by a standstill time section 8. The duration of the sections 7 and 8 in each case amount to $\frac{1}{2}f$ minutes. During the standstill time section 8 the curves I and II extend coaxially with respect to the abscissa. As can be seen from the Equation 3 there follows a mean or average velocity $v''$ over the entire time duration of the lateral displacement of the short side, which satisfies the following relationship: $v'' = f \cdot S \cdot \tan\theta$mm/min (horizontal continuous curve III of FIG. 3*b*). A series of tests have shown that even with a linear course according to curve II of FIG. 3*b*, during an intermittently performed movement, there do not occur in practice any appreciable problems. Tests have further shown that it is unnecessary to limit the casting speed. The horizontal displacement of the short side occurs independently of the casting speed. Since the momentary change in shape or format of the steel strand is very small, it is possible to carry out a strand width adjustment during casting without danger of metal breakout.

During a test for reducing the width of a steel slab having a thickness of 220 mm there was employed an initial width W1 = 1200 mm. The slab withdrawal speed amounted to G = 1 m/min, the frequency $f$ of the mold oscillations = 75 cycles/min, the length of stroke or double amplitude of the oscillations S = 10 mm, the taper $\tan\theta = 0.35$. The mold height amounted to 700 mm and the height of the molten bath amounted to 600 mm. The mean or average displacement speed towards the center of the mold amounted to $v'' = 4.5$ mm/min and the mold small sides 2 were displaced through a total width of 50 mm, so that the obtained reduced width amounted to W2 = 1150 mm. The transition region or zone $k$ amounted to 5600 mm. At the edges of the slab there were neither observed lengthwise fissures nor depressions or any other irregularities.

With the use of small forces applied to the narrow or small sides 2 of the mold 2, 3 the strand shell or skin can be depressed infinitely and nonetheless rapidly and positively.

While there are shown and described present preferred embodiments of the invention, it is to be distinctly understood that the invention is not limited thereto, but may be otherwise variously embodied and practiced within the scope of the following claims.

Accordingly, we claim:

1. In a method of decreasing the width of a continuously cast strand, especially a steel strand, wherein at least one small side of an adjustable, oscillating continuous casting mold is displaced during the casting operation, the improvement which comprises:

intermittently moving the small side of the mold in the direction of the center of the mold at a mean velocity of $v'' \leqq f \times S \times \tan \theta$, in such a manner that there successively follow one another movement- and standstill time sections each amounting to $\frac{1}{2}f$ minutes, and wherein;

$f$ represents the mold oscillation frequency in cycles per minute, S the double amplitude of the oscillating mold, and $\theta$ the taper angle enclosed by the short side of the mold with the vertical.

2. The improvement as defined in claim 1, further including the steps of:

maintaining an intermediate space which does not exceed 0.5 mm between the short side and a long side of the mold during movement of said small side.

* * * * *